US006529112B1

(12) United States Patent
Leone

(10) Patent No.: US 6,529,112 B1
(45) Date of Patent: Mar. 4, 2003

(54) RING TONGUE LUG RETAINER MOLDED CASE CIRCUIT BREAKER

(75) Inventor: David A. Leone, Lilburn, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 65 days.

(21) Appl. No.: 09/880,563

(22) Filed: Jun. 13, 2001

(51) Int. Cl.[7] ..... H01H 71/08; H01R 4/36

(52) U.S. Cl. ..... 337/113; 337/86; 439/810; 439/814

(58) Field of Search ..... 337/12, 13, 16, 337/35, 36, 86, 113, 381, 400; 361/626, 642, 646; 335/23, 26, 35, 36; 439/810, 814

(56) References Cited

U.S. PATENT DOCUMENTS

| | | | | | |
|---|---|---|---|---|---|
| 2,313,927 | A | * | 3/1943 | Dorfman | 439/814 |
| 2,727,220 | A | * | 12/1955 | Buchanan et al. | 248/500 |
| 3,086,194 | A | * | 4/1963 | Price | 439/812 |
| 3,344,394 | A | * | 9/1967 | Kingsbury et al. | 200/237 |
| 4,040,700 | A | * | 8/1977 | Obuch | 439/431 |
| 4,809,132 | A | * | 2/1989 | Palmieri et al. | 335/202 |
| 4,830,627 | A | * | 5/1989 | Heng et al. | 439/586 |
| 4,861,290 | A | * | 8/1989 | Halmstad et al. | 205/185 |
| 4,868,981 | A | * | 9/1989 | Hinckley et al. | 29/857 |
| 4,905,122 | A | | 2/1990 | Culnan et al. | 361/376 |
| 5,005,104 | A | * | 4/1991 | Grunert et al. | 335/202 |
| 5,107,396 | A | | 4/1992 | Rosen et al. | 361/355 |
| 5,301,086 | A | | 4/1994 | Harris et al. | 361/641 |
| 5,368,506 | A | * | 11/1994 | Heimbrock | 439/709 |
| 5,488,337 | A | | 1/1996 | Hubbard et al. | 335/202 |
| 5,493,085 | A | * | 2/1996 | Kolberg et al. | 200/51 R |
| 5,759,072 | A | * | 6/1998 | Chadbourne et al. | 439/814 |
| 5,772,479 | A | | 6/1998 | Fleege et al. | 439/801 |
| 5,811,749 | A | | 9/1998 | Bausch et al. | 218/157 |
| 5,831,498 | A | | 11/1998 | Maloney et al. | 335/8 |
| 5,957,733 | A | * | 9/1999 | Mello et al. | 439/810 |
| 5,978,208 | A | * | 11/1999 | Helms et al. | 200/284 |
| 6,099,344 | A | * | 8/2000 | Chadbourne | 439/416 |
| 6,280,264 | B1 | * | 8/2001 | Whipple et al. | 335/202 |
| 6,338,658 | B1 | * | 1/2002 | Sweeney | 439/709 |

FOREIGN PATENT DOCUMENTS

| | | | | | |
|---|---|---|---|---|---|
| FR | 2573926 | A1 | * | 5/1986 | H01R/4/36 |
| GB | 2057794 | A | * | 4/1981 | H01R/4/36 |
| JP | 01031355 | A | * | 2/1989 | H01R/4/36 |

* cited by examiner

*Primary Examiner*—Anatoly Vortman
(74) *Attorney, Agent, or Firm*—Foley & Lardner

(57) ABSTRACT

A ring tongue lug retainer in a circuit breaker with the circuit breaker having a line bus conductor and a load bus conductor, wherein electrical conductors are connected to the line and load bus conductors. The ring tongue lug retainer comprises a lug body having a throughbore defining at least two interior walls and a threaded screw hole aligned perpendicular to and in communication with the throughbore. A thread portion may be provided in each interior wall of the lug body engages the binding screw configured to threadingly engage the screw hole and the lug body. The binding screw has a ring tongue protrusion configured to engage a ring tongue terminal of the electrical conductors.

17 Claims, 2 Drawing Sheets

RING TONGUE LUG RETAINER MOLDED CASE CIRCUIT BREAKER

FIELD OF THE INVENTION

The present invention relates generally to the field of circuit breakers, and more particularly to a ring tongue lug retainer for a molded case circuit breaker.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as the period of time that that current is flowing. For a given range of current ratings, the bi-metal cross-section and related elements are specifically selected for such current range resulting in a number of different current ranges for each circuit breaker. Electronic trip units are also used in some applications.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. Again, electronic trip units can also be used.

Ratings of circuit breakers are continually increasing due to market driven requirements for space saving electrical equipment. As the ampere rating for a given circuit breaker frame size increases, space for wiring lugs within that circuit breaker becomes a premium. Lug size for attaching the various wires and cables is primarily driven by the wiring cable dimensions as defined in the National Electric Code or other country specific wiring standards or practices. Although this problem exists for all circuit breakers, it is especially acute for circuit breakers in the 100 amp to 125 amp range.

Existing techniques for connection of the various wires and cables relative to the circuit breaker is done with a lug mounted in the circuit breaker. A wire or cable is inserted into the lug and a screw is turned and engages the wire typically with a crushing or squashing of the wires as the screw is turned down in the lug. The screw may have a plate fixed at its bottom with prongs that engage the cable or wire. The lug is typically mounted in the circuit breaker either by additional hardware such as screws or rivets or by a series of tabs and notches configured in either the housing of the circuit breaker or the lug or both. In some instances, a wire or cable has a ring tongue connector or the like mounted by solder or crimping as a terminator for the wire end. The ring tongue connector is then bolted or screwed to the line and load bus conductors of the circuit breaker. In other instances the ring tongue is simply squeezed by the lug screw as the lug screw is turned into the wire lug, usually with less than 100% mechanical or electrical contact being made between the ring tongue connector and the electrical bus conductor.

The existing wiring connections require either additional hardware, special manufacturing techniques for the wire lug and circuit breaker housing, or the electrical connection does not utilize the entire portion of the ring tongue terminator which is engaged by the wire lug of the circuit breaker.

Thus, there is a need for a positive ring tongue securing apparatus that provides maximum annular contact of the ring tongue and bus bar conductor in a circuit breaker. There is also a need for a lug retainer that does not require separate hardware to hold the lug in place. There is also a need for a circuit breaker that allows the wire lug to be easily mounted to the bus conductor of the circuit breaker during manufacturing or field repair.

SUMMARY OF THE INVENTION

The present invention provides a ring tongue lug retainer in a circuit breaker with the circuit breaker having a line bus conductor and a load bus conductor, wherein electrical conductors are connected to the line and load bus conductors. The ring tongue lug retainer comprises a lug body having a throughbore defining at least two interior walls and a threaded screw hole aligned perpendicular to and in communication with the throughbore. A thread portion in each interior wall of the lug body may be provided to engage the binding screw configured to threadingly engage the screw hole and the lug body. The binding screw has a ring tongue protrusion configured to engage a ring tongue terminal of the electrical conductors. The ring tongue protrusion can be one selected from a group comprising a cylinder with a round end, a trunkated cone, a cylinder with a pointed end and a cylinder with a flat end and spherical knob. Another embodiment of the ring tongue lug retainer includes a slot extending into the lug body and in communication with the throughbore. The slot can be configured to engage one of the line bus conductor and load bus conductor and the slot may extend through the lug body.

The present invention further provides a molded case circuit breaker comprising a molded housing, a line bus conductor and a load bus conductor inserted in the housing with the first contact coupled to the line bus conductor and a second contact coupled to the load bus conductor. An operating mechanism having a pivoting member movable between an "ON" position, and "OFF" position and a "TRIPPED" position, with the pivoting member coupled to the second contact. A trip unit coupled to the second contact and the load bus conductor is selectively in operative contact with the operating mechanism. An electric arc extinguishing apparatus is mounted in the housing and is positioned in confronting relation with the first and second contacts, a ring tongue lug retainer is mounted in the circuit breaker housing at one of the load and line terminals. The ring tongue lug retainer comprises a lug body having a throughbore defining at least two interior walls and a threaded screw hole aligned perpendicular to and in communication with the throughbore. A thread portion in each interior wall of the lug body may be provided and a binding screw configured to threadingly engage the screw hole and the lug body. The binding screw has a ring tongue protrusion configured to engage a terminal, such as a ring tongue, on the electrical conductors.

The present invention also provides a circuit breaker comprising a molded housing including a base, with a means for connecting a load to the circuit breaker mounted in the housing and a means for connecting an electrical line to the circuit breaker mounted in the housing. A means for coupling electrically to the means for connecting an electrical line is also provided. A movable means for contacting the means for connecting an electrical line to a means for operating is mounted in the housing coupled with the means for operating having a pivoting member movable between an "ON" position, an "OFF" position and a "TRIPPED" position. The pivoting member is coupled to the movable means for contacting and with the means for operating. A means for tripping is coupled to the movable means for contacting and the means for connecting a load with the means for operating wherein the means for tripping includes a means for releasing under short circuit condition and a means for releasing under an overload condition. A means for extinguishing an electrical arc is mounted in the housing with a movable means for contacting extended into the means for extinguishing. A means for retaining having a throughbore and coupled to one of the means for connecting a load and the means for connecting an electrical line is also provided. In another embodiment, the means for retaining includes the slot in communication with the throughbore.

DETAILED DESCRIPTION OF THE PREFERRED EMBODIMENTS

Figure 1:
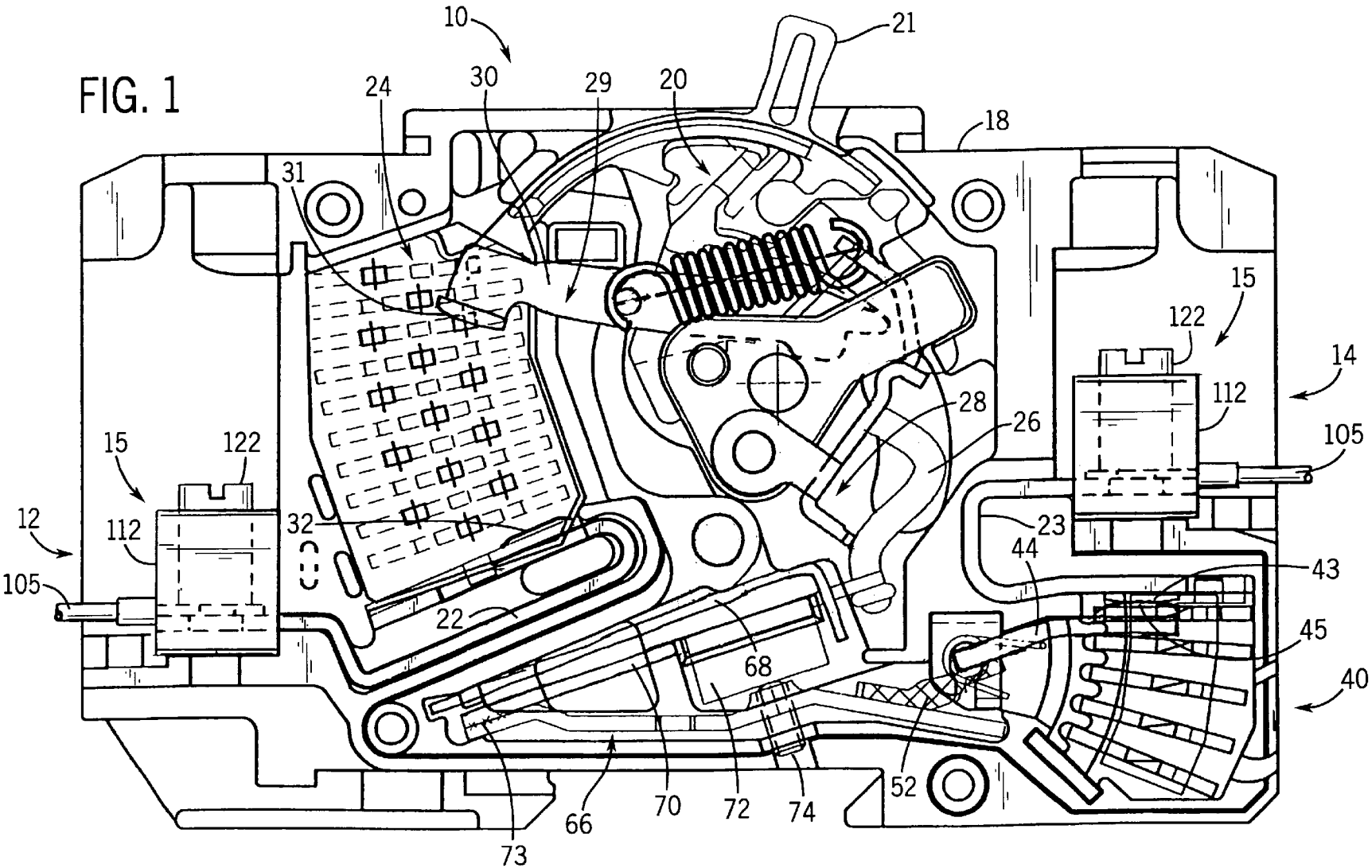
FIG. 1 is a side cut-away view of a molded case circuit breaker providing an exemplary embodiment of a lug retainer mounted in the housing at the line terminal and load terminal and with the lug retainer binding screw having a protrusion of a cylinder with a spherical knob type.

FIG. 1 generally illustrates single phase molded case circuit breaker 10 that includes an operating mechanism 20 having a handle 21. The operating mechanism 20 is mounted within a housing 18. The handle 21 is movable between an "ON" position, an "OFF" position and a "TRIPPED" position. The exemplary circuit breaker 10 is a single pole breaker however, it is contemplated that the several exemplary embodiments may be practiced in a three-phase or in other multi-phase circuit breakers. In such multi-phase breaker, each pole would have its own ring tongue lug retainer 110 aligned in the one of the line terminal 12 and load terminal 14 as dictated by the specific circuit breaker design. It is also contemplated to use an embodiment of the ring tongue lug retainer 110 in a circuit breaker having an auxiliary contact apparatus 40 as shown in FIG. 1.

The molded case circuit breaker 10 has a line terminal 12 and a load terminal 14 to which electrical wires or cables 105 are attached when the circuit breaker 10 is installed in a selected circuit. The housing 18 encloses the components of the circuit breaker including an operating mechanism 20 to which a main movable contact arm 30 and a trip assembly 28 are coupled.

An auxiliary contact apparatus 40 can be mounted within a suitable void in the housing 18 of the circuit breaker 10 and coupled in series with the main movable contact arm 30. It is contemplated that an existing molded case circuit breaker will be minimally modified to accommodate the auxiliary contact apparatus 40. However, it is also contemplated that a new molded case circuit breaker design case initially incorporate the auxiliary contact apparatus 40.

A bi-metal/magnetic trip assembly 66 is mounted in the housing 18 of the circuit breaker 10 and couples the load bus 23 to the main movable contact arm 30 via a main braid 26 through the bi-metal. The bi-metal assembly includes the bi-metal element 70 fixed at one end to the load bus 23 at a joint 73 formed by the load bus 23 and the bi-metal 70. The joint 73 is created by suitable weld or braze. A magnetic armature 68 and a magnetic yoke 72 form a part of the bi-metal assembly 66. The response characteristics of the bi-metal/magnetic trip assembly 66 is controlled by a calibrating screw 74 mounted in the load bus 23 and by the physical attributes of the trip assembly.

In operation, with the circuit breaker 10 in the ON position, the main movable contact arm 30 and main stationary contact 32 are closed. In such condition, the current flows through the line terminal 12 into the line bus 22 and through the main stationary contact 32 into the main movable contact arm 30 of the primary contact apparatus 29. The current then flows through the main braid 26 into the bi-metal/magnetic trip assembly 66 and then through the load bus 23 through the load terminal 14 and onto the load (not shown). In the event that an auxiliary contact apparatus 40 is utilized, the current would flow from the load bus 23, through the auxiliary braid 52 into the auxiliary movable contact arm 44 and into the auxiliary movable contact arm contact pad 45 to the auxiliary stationary contact pad 43, and into the load terminal 14.

Under a short circuit condition, the circuit breaker 10 will experience high current flowing through the circuit described above. Such high current will cause the magnetic yoke 72 and the magnetic armature 68 in the bi-metal/magnetic trip assembly 66 to activate the trip assembly 28 of the circuit breaker 10.

The electrical arc typically created during the opening of the contact arm 30 and contact pad 32 under short circuit conditions, is drawn into an arc chute structure 24 which extends and cools the arc to assist in the current interruption operation of the circuit breaker. The main movable contact on arm 30 and the main stationary contact 32 are blown apart by the magnetic force generated under the short circuit condition. The operating mechanism 20, trip assembly 28 and the bi-metal assembly 66 of the circuit breaker 10 also operates to hold the main movable contact arm 30 in its TRIPPED and OPENED position. With the circuit opened, the main movable contact arm 30 remains in an open position until the handle 21 of the circuit breaker 10 is reset and placed in the ON position. This can be done manually by an operator or can be done by a motor coupled to the circuit breaker or by a stored energy device coupled to the circuit breaker.

An arc chute structure 24 typically includes two arch chute side panels having a plurality of slots support a plurality of arc plates (See FIG. 1). The arc plates, as best seen in FIG. 1, are generally U-shaped and are stacked between the two side plates. The arc plates can be provided with tabs which engage the slots to form the arc chute structure. In the stacked position, as shown in the figures, an arc channel is formed between the two legs of each arc plate. When inserted into the housing 18 of the circuit breaker 10, the arc chute structure 24 is aligned with the movable contact arm 30 of the operating mechanism 20. The movable contact arm 30 moves through the channel of the arc chute structure 24 as the movable contact arm 30 moves from one position to another position. During a short circuit condition, as the movable contact arm 30 opens an electrical arc is drawn between the contact pads of the contact arm 30 and the stationary contact 32. Such electric arc extends into the arc chute structure 24 which lengthens and cools the arc as the arc voltage increases until the current ceases to flow in the circuit. An arc runner can also be provided on the movable contact arm to facilitate the extension, into the arc channel, of the arc generated during a short circuit condition. The arc runner can be integrally formed with the movable contact arm during the manufacture of the contact apparatus.

In order to increase the current rating of the circuit breaker 10, the circuit breaker must accommodate the large cables and wires used to connect the circuit breaker to the circuit being protected. The National Electrical Code and other countries' specific wiring standards or practices specify the size and diameter of the cables and wires to be used at specific current levels. In some cases it is necessary to provide a barrier between the lug 15 and the housing 18 of the circuit breaker 10 as well as to protect the lug 15 and cable 105 from the arc chamber 24 venting gases generated during operation of the circuit breaker, particularly in short circuit condition. In addition, it is also necessary to insulate the wire lug 15 and cables, particularly in a multi-pole breaker arrangement to prevent arcing between poles as the circuit breaker operates to break the circuit.

The present ring tongue lug retainer 110 type of lug 15 for attaching the cable 105 to the load bus conductor 23 and line bus conductor 22 is utilized for such purposes (See FIGS. 2–5). In a circuit breaker 10 having a housing 18 with a terminal for a load connection 14 and a terminal for a line connection 12 including a ring tongue lug retainer 110 for connecting electrical conductor 105 to the line and load bus conductor 22, 23.

Figure 2:
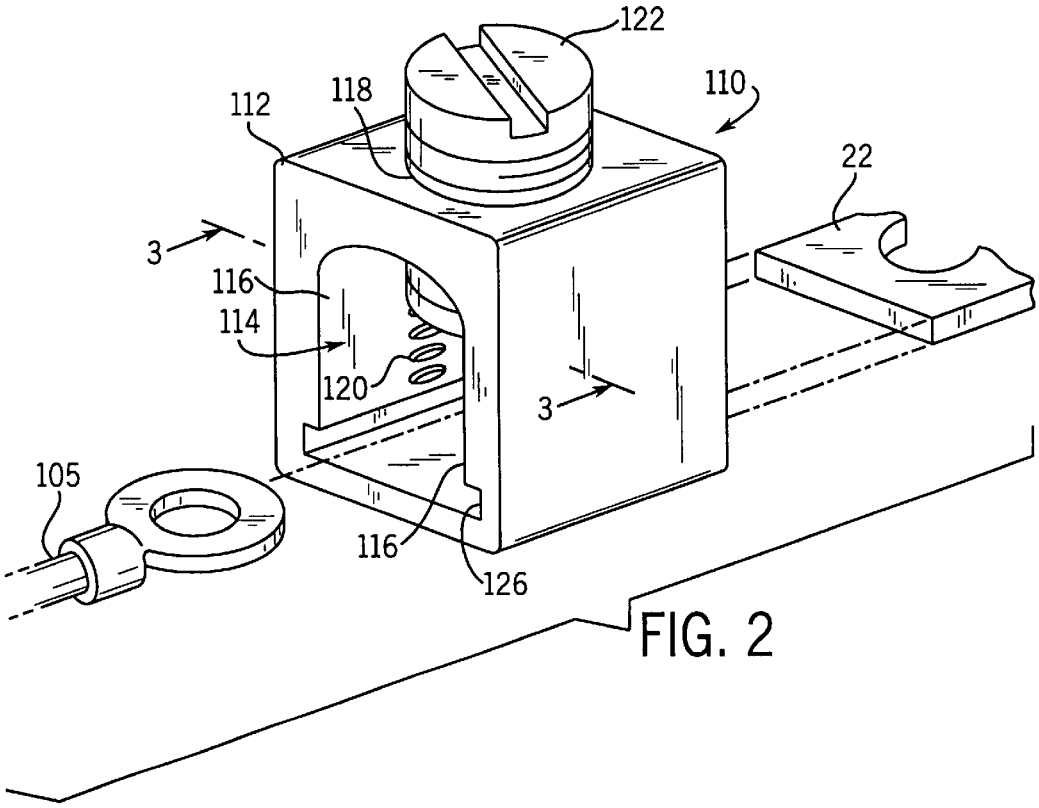
FIG. 2 is a perspective illustration of an exemplary embodiment of a ring tongue lug retainer and an electrical conductor and a bus conductor and illustrating a ring tongue protrusion of a cylinder with a flat end type.

The ring tongue lug retainer 110 comprises a lug body 112 having a throughbore 114 defining at least two interior walls 116 and a threaded screw hole 118 aligned perpendicular to and in communication with the throughbore 114. A thread portion 120 may be provided in each interior wall 116 of the lug body 112 to receive the binding screw 122. The binding screw 122 is configured to threadingly engage the screw hole 118 in the lug body 112 and may also engage, if provided, the thread portion 120. The binding screw 122 has a ring tongue protrusion 124 configured to engage the electrical conductors 105. The electrical conductor 105 may or may not have an end terminal attached to the conductor. In some instances the bare cable may be inserted into the lug 15 or, as illustrated in FIG. 2, an end terminal such as a ring tongue may be used.

The ring tongue protrusion 124 can be machined, molded or formed at one end of the binding screw. The protrusion 124 can be one selected from a group comprising a cylinder with a round end, a truncated cone, a cylinder with a pointed end, and a cylinder with a flat end and a spherical knob. Exemplary embodiments of such ring tongue protrusions 124 are shown in FIGS. 1–5. It should be understood that other configurations for the protrusion can be utilized and configured to engage types of wire termination devices other than the ring tongue lug illustrated in FIG. 2. It should also be understood that the illustrated protrusion can engage other types of wire termination devices.

Figure 3:
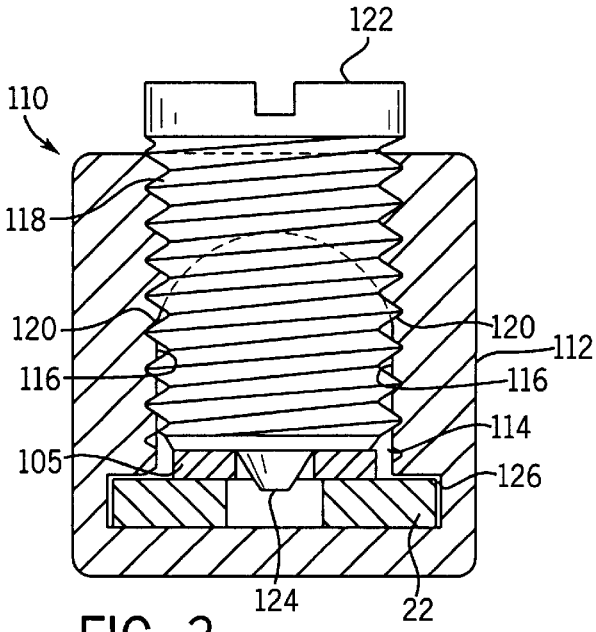
FIG. 3 is a sectional view of an exemplary embodiment of a ring tongue lug retainer along the lines 3—3, as shown in FIG. 2 and illustrating a ring tongue protrusion of a truncated cone type.
Figure 4:
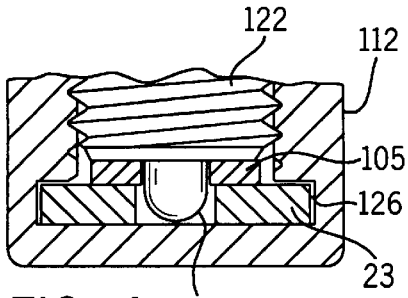
FIG. 4 is a partial sectional view of an exemplary embodiment of a ring tongue lug retainer along the lines 3—3, as shown in FIG. 2 and illustrating a ring tongue protrusion of a cylinder with a round end type.
Figure 5:
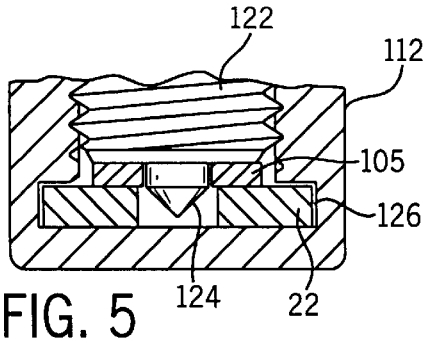
FIG. 5 is a partial sectional view of an exemplary embodiment of a ring tongue lug retainer along the lines 3—3, as shown in FIG. 2 and illustrating a ring tongue protrusion of a cylinder with a pointed end type.

The ring tongue lug retainer 110 can include a slot 126 extending into the lug body 112 that is in communication with the throughbore 114. The slot 126 is configured to engage one of the line bus conductor 22 and load bus conductor 23. The slot 126 can also extend through the lug body 112 as illustrated in FIGS. 1 and 2. The slot is configured to engage the bus conductor 22, 23 which in addition to providing mechanical and electrical contact between the ring tongue lug of the electrical conductors 105 also provides a mechanical retention of the ring tongue lug retainer 110 within the housing 18 of the circuit breaker 10. Such configuration allows the ring tongue lug retainer 110 to be maintained in the circuit breaker 10 without additional hardware such as screws, rivets or notches and protrusions in the housing 18 of the circuit breaker 10. In addition, the ring tongue protrusion 124 of the binding screw 122 provides for 100% annular contact of the ring tongue lug and the bus conductors 22, 23 as shown in FIGS. 3–5. The protrusion 124 engages the hole typically found in the ring tongue lug type wire terminal. (See FIGS. 2–5)

The ring tongue lug retainer 110 can be machined, molded or cast, from a metal or from an engineered plastic of suitable strength, thermal, and electrical characteristics for the type of circuit breaker rating intended by the manufacturer.

Thus, there is provided a circuit breaker with a line terminal and a load terminal, having an operating mechanism with a main movable contact arm coupled to a load terminal and a ring tongue lug retainer for connecting an electrical conductor to the line and load bus conductor of the circuit breaker. While the embodiments illustrated in the figures and described above are presently preferred, it should be understood that these embodiments are offered by way of example only. The invention is not intended to be limited to any particular embodiment, but is intended to extend to various modifications that nevertheless fall within the scope of the appended claims. For example, it is also contemplated that the trip mechanism can include an intermediate latching mechanism and can be an electronic mechanism or that the load terminal can be housed in a separate housing capable of mechanically and electrically connecting to another housing containing the operating mechanism and line terminal with the ring tongue lug retainer thereby providing for a quick and easy change of current rating for an application of the circuit breaker contemplated herein. It is also contemplated that the ring tongue lug retainer can be used in a multi-phase molded case circuit breaker which may include a separate auxiliary contact apparatus provided in series with each pole of the multi-pole circuit breaker. Additional modifications will be evident to those with ordinary skill in the art.

What is claimed is:

1. A ring tongue lug retainer in a circuit breaker having a line bus conductor and a load bus conductor, wherein electrical conductors are connected to the line and load bus conductors, the ring tongue lug retainer comprising:

a lug body having a throughbore defining at least two interior walls and a screw hole aligned perpendicular to and in communication with the throughbore; and a binding screw configured to threadingly engage the screw hole in the lug body, with the binding screw having a ring tongue protrusion configured to engage the electrical conductors.

2. The ring tongue lug retainer of claim 1, including a thread portion in each interior wall of the lug body.

3. The ring tongue lug retainer of claim 1, wherein the ring tongue protrusion is one selected from a group comprising a cylinder with a round end, a truncated cone, a cylinder with a pointed end, and cylinder with a flat end and a spherical knob.

4. The ring tongue lug retainer of claim 1, including a slot extending into the lug body and in communication with the throughbore.

5. The ring tongue lug retainer of claim 4, wherein the slot is configured to engage one of the line bus conductor and load bus conductor.

6. The ring tongue lug retainer of claim 4, wherein the slot extends through the lug body.

7. A molded case circuit breaker comprising:

a molded housing;

a line bus conductor and load bus conductor inserted in the housing;

a first contact coupled to the line bus conductor;

a second contact coupled to the load bus conductor;

an operating mechanism having a pivoting member moveable between an ON position, an OFF position and a TRIPPED position, wherein the pivoting member is coupled to the second contact;

a trip unit coupled to the second contact and the load bus conductor with the trip unit in selective operative contact with the operating mechanism;

an electric arc extinguishing apparatus mounted in the housing and positioned in confronting relation with the first and second contacts; and, a ring tongue lug retainer comprising:

a lug body having a throughbore defining at least two interior walls and a screw hole aligned perpendicular to and in communication with the throughbore; and a binding screw configured to threadingly engage the screw hole in the lug body, with the binding screw having a ring tongue protrusion configured to engage the electrical conductor.

8. The molded case circuit breaker of claim 7, including a thread portion in each interior wall of the lug body.

9. The molded case circuit breaker of claim 7, wherein the ring tongue protrusion is one selected from a group comprising a cylinder with a round end, a truncated cone, a cylinder with a pointed end, and cylinder with a flat end and a spherical knob.

10. The molded case circuit breaker of claim 7, including a slot in the lug body and in communication with the throughbore.

11. The molded case circuit breaker of claim 10, wherein the slot is configured to engage one of the line bus conductor and load bus conductor.

12. The molded case circuit breaker of claim 10, wherein the slot extends through the lug body.

13. A circuit breaker comprising:

a molded housing including a base;

a means for connecting a load to the circuit breaker, mounted in the housing;

a means for connecting an electrical line to the circuit breaker, mounted in the housing;

a means for coupling electrically to the means for connecting an electrical line;

a movable means for contacting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating.

a means for tripping coupled to the movable means for contacting and the means for connecting a load with the means for operating wherein the means for tripping includes a means for releasing under a short circuit condition and a means for releasing under an overload condition;

a means for extinguishing an electric arc mounted in the housing with the movable means for contacting extending into the means for extinguishing; and, a means for retaining a ring tongue lug having a throughbore and a means for engaging extendable into the throughbore and having a ring tongue protrusion configured to engage to one of the means for connecting a load and the means for connecting an electrical line.

14. The circuit breaker of claim 13, wherein the protrusion is selected from a group comprising a cylinder with a round end, a truncated cone, a cylinder with a pointed end, and cylinder with a flat end and a spherical knob.

15. The circuit breaker of claim 13, wherein the means for retaining includes a slot in communication with the throughbore.

16. The circuit breaker of claim 15, wherein the slot is configured to engage one of the means for connecting a load and the means for connecting an electrical line.

17. The circuit breaker of claim 15, wherein the slot extends through the means for retaining.

* * * * *